United States Patent [19]

Bury et al.

[11] 4,278,464

[45] Jul. 14, 1981

[54] METHOD FOR PREVENTING SLOPPING DURING SUBSURFACE PNEUMATIC REFINING OF STEEL

[75] Inventors: Roland P. Bury, Marcimelle, Belgium; Stewart K. Mehlman, Tarrytown; Rockne J. Andreini, New York, both of N.Y.

[73] Assignee: Union Carbide Corporation, New York, N.Y.

[21] Appl. No.: 107,535

[22] Filed: Dec. 27, 1979

[51] Int. Cl.[3] ..... C21C 7/00; C21C 5/30

[52] U.S. Cl. ..... 75/51; 75/52; 75/57; 75/59; 75/60

[58] Field of Search ..... 75/51, 53, 59, 57, 60, 75/52

[56] References Cited

U.S. PATENT DOCUMENTS

| | | | |
|---|---|---|---|
| 3,107,995 | 10/1963 | Katakura | 75/57 |
| 3,702,243 | 11/1972 | Miltenberger | 75/57 |
| 3,960,546 | 1/1976 | Rote | 75/60 |
| 4,187,102 | 2/1980 | Choulet | 75/60 |
| 4,210,442 | 7/1980 | Lewis | 75/60 |

*Primary Examiner*—P. D. Rosenberg

*Attorney, Agent, or Firm*—Lawrence G. Kastriner

[57] ABSTRACT

The desired tap temperature may be obtained, without slopping, during subsurface pneumatic refining of steel by the addition to the melt of an oxidizable fuel material, such as aluminum, after decarburization has been substantially completed or after the carbon content has fallen below 0.50%.

5 Claims, 1 Drawing Figure

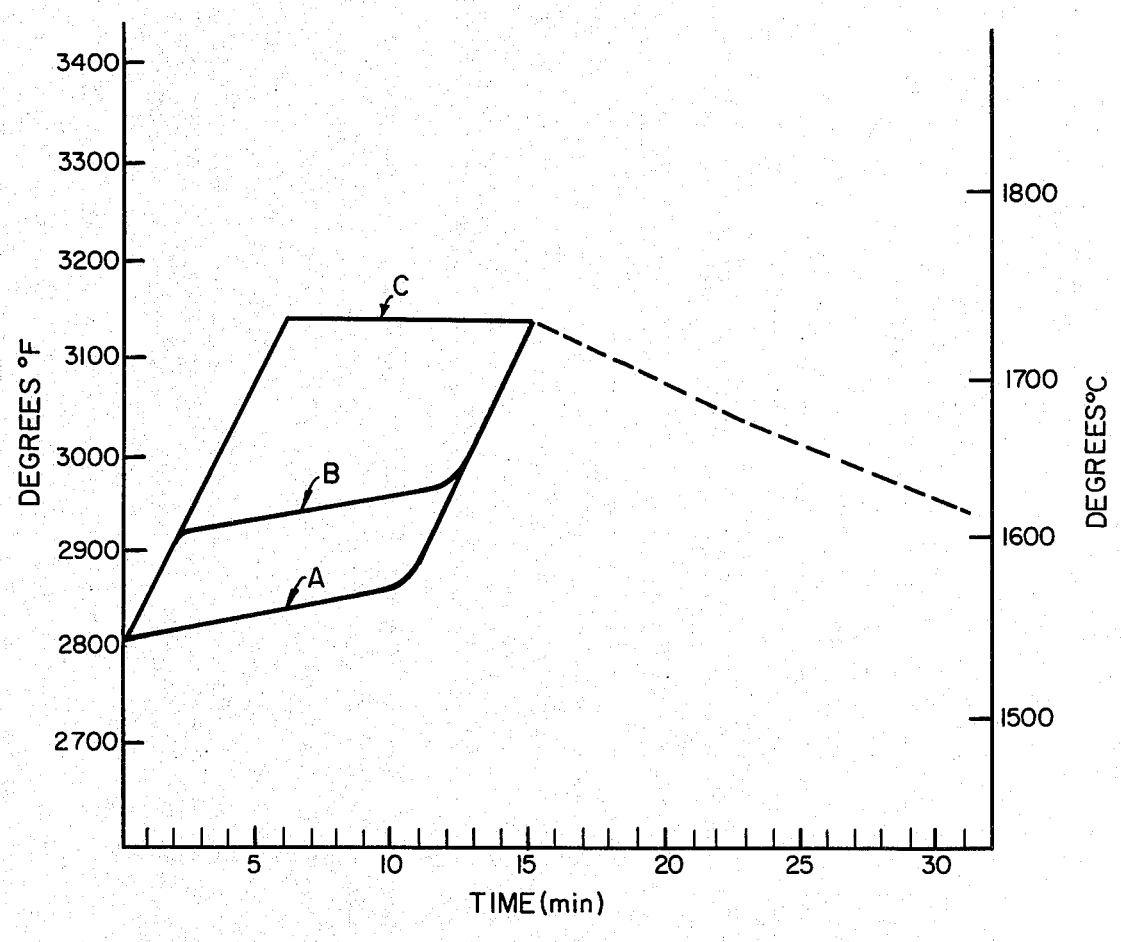
3400
3300
3200
3100
3000
2900
2800
2700
DEGREES °F
1800
1700
1600
1500
DEGREES°C
C
B
A
5
10
15
20
25
30
TIME (min)

METHOD FOR PREVENTING SLOPPING DURING SUBSURFACE PNEUMATIC REFINING OF STEEL

BACKGROUND

This application relates to the refining of steel, and more specifically to the subsurface pneumatic refining of steels which requires the addition of a fuel material in order to obtain the desired tap temperature without encountering slopping.

The term "subsurface pneumatic refining" as used in the present specification and claims is intended to mean a process wherein decarburization of the melt is achieved by the subsurface injection of oxygen gas, alone or in combination with one or more gases selected from the group consisting of argon, nitrogen, ammonia, steam, carbon monoxide, carbon dioxide, hydrogen, methane or higher hydrocarbon gases. The gases may be blown in by following various blowing programs depending on the grade of steel made and on the specific gases used in combination with oxygen. The refining period frequently ends with certain finishing steps, such as lime and/or alloy additions to reduce the oxidized alloying elements and form a basic slag, and addition of alloying elements to adjust the melt composition to meet melt specifications.

Several subsurface pneumatic steel refining processes are known in the art; including, for example, the AOD, CLU, OBM, Q-BOP and the LWS processes. U.S. patents illustrative of these processes, respectively are: U.S. Pat. Nos. 3,252,790; 3,867,135; 3,706,549; 3,930,843 and 3,844,768.

During pneumatic refining, the melt is heated by the exothermic oxidation reactions which take place during the decarburization stage of the refining period. The melt cools quite rapidly during the finishing stage since the additions of lime and alloying elements are endothermic, as well as the fact that no exothermic reactions are taking place.

Subsurface pneumatic refining, commonly referred to in the art as "blowing", normally produces one or more of the following results: decarburization, deoxidation, desulfurization, dephosphorization and degassing of the heat. In order to obtain these results it is necessary: (1) to provide sufficient oxygen to burn out the carbon to the desired level (decarburization), and (2) to provide sufficient sparging gas to: thoroughly mix the deoxidizing additions into the melt (deoxidation), achieve good slagmetal interaction (desulfurization), and assure that low levels of hydrogen and nitrogen will be obtained in the melt (degassing).

Pneumatic refining has two opposing temperature constraints. One is that a sufficiently high temperature be attained by the exothermic reactions to permit the endothermic steps to be carried out while maintaining the temperature of the melt sufficiently high for tapping of the heat. The opposing restraint is that the peak temperature attained in the refining vessel be held below that which will cause excessive deterioration of the refractory lining of the vessel.

Although the present invention is applicable to all of the above-mentioned subsurface pneumatic steel refining processes, for purposes of convenience, the invention will be described and illustrated by reference to the argon-oxygen decarburization process, also referred to for short as the AOD process.

The term, "argon-oxygen decarburization process" as used in the present specification and claims is meant to define a process for refining molten metal contained in a refining vessel which is provided with at least one submerged tuyere, comprising (a) injecting into the melt through said tuyere(s) an oxygen-containing gas containing up to 90% of a dilution gas, wherein said dilution gas functions to reduce the partial pressure of the carbon monoxide in the gas bubbles formed during decarburization of the melt and/or to alter the feed rate of oxygen to the melt without substantially altering the total injected gas flow rate, and thereafter (b) injecting a sparging gas into the melt through said tyere(s) wherein said sparging gas functions to remove impurities from the melt by degassing, deoxidation, volatilization, or by flotation of said impurities with subsequent entrapment or reaction with the slag. The process normally has the oxygen-containing gas stream surrounded by an annular stream of protective fluid which functions to protect the tuyere(s) and the surrounding refractory lining from excessive wear. Useful dilution gases include: argon, helium, hydrogen, nitrogen, carbon monoxide, carbon dioxide or steam; argon is preferred. Useful sparging gases include argon, helium, nitrogen and steam; argon being preferred. Useful protective fluids include argon, helium, hydrogen, nitrogen, carbon monoxide, carbon dioxide, steam or a hydrocarbon fluid; argon again is preferred.

During refining, the temperature of the melt is influenced by those factors that constitute head losses and those that constitute heat gains. Heat is required:

(1) to raise the temperature of the melt from its charge temperature to its tap temperature, (2) to dissolve lime and other constituents of the slag, (3) to dissolve any alloy, scrap or other additions made during refining, and (4) to make up for the heat lost by the melt to its surroundings during the overall refining period (i.e. during inert gas stirring, blowing, reduction and turndowns).

Heat is supplied during the refining period only by the exothermic reactions which take place during refining. These include the oxidation of carbon, silicon, aluminum and any other metallic constituents in the melt, such as, for example, iron, chrome and manganese. If after refining, the melt temperature is insufficient to achieve the desired tap temperature, it is common practice to reblow the heat with oxygen, thereby generating heat by the oxidation of carbon and metallic elements in the melt. Such reblowing, however, is undesirable because it takes additional time, requires the use of additional oxygen, silicon and lime, and causes undesirable oxidation of metallic elements in the melt, all of which produce inefficiency in the overall refining operations, and adversely affect the quality of the metal.

One way of avoiding the above-mentioned problem is disclosed by Choulet and Mehlman in U.S. Pat. No. 4,187,102 issued on Feb. 5, 1980. The method described therein comprises the addition of fast and slow oxidizing elements to the melt (such as aluminum and silicon, respectively) before starting the injection of refining oxygen. The heat provided by the oxidation of these elements must be sufficient to leave the temperature of the melt at the end of the refining period at least equal to the desired tap temperature, but not so great as to cause excessive refractory deterioration. While satisfactory in many cases, the process disclosed by Choulet and Mehlman may cause severe "slopping" in some instances.

"Slopping" is a metallurigcal phenomenon common to pneumatic refining of metals wherein the slag-metal emulsion formed above the melt being refined surges up and out the open mouth of the refining vessel. Slopping is not only detrimental to yield, but dangerous to workers who are near the vessel.

It has been found that the following factors increase the tendency of a heat of steel to slop during AOD refining:

1. High rates of carbon monoxide evolution.
2. High gas (argon and/or oxygen) blowing rates.
3. Small freeboard volume in the refining vessel.
4. Formation of a slag-metal emulsion.

OBJECTS

It is the object of this invention to provide a method for avoiding slopping during the subsurface pneumatic refining of steels, such as carbon steels, low alloy steels and tool steels—while at the same time obtaining the desired tap temperature—without the need for reblowing the heat and without reaching temperatures during refining that cause excessive refractory deterioration.

SUMMARY OF THE INVENTION

The above and other objects, which will be apparent to those skilled in the art, are achieved by the present invention which comprises:

a method for preventing slopping during subsurface pneumatic refining of a steel melt which requires fuel additions, while simultaneously controlling the temperature of the melt, comprising:

adding an oxidizable fuel material to the melt in an amount sufficient to obtain the desired tap temperature at the end of the refining period, at a time after the melt has been decarburized to substantially the specification carbon content or after the carbon content has fallen below 0.50%.

The term "oxidizable fuel material" as used in the present specification and claims is meant to include those materials whose oxidation is thermodynamically favored over carbon at steel making temperatures, which possess a high heat release per unit of oxygen, that is, greater than 1000 BTU per normal cu. ft. of oxygen—measured at 70° F. and 1 atm. pressure ($9.6\times10^6$ calories per normal cubic meter-measured at 0° C. and 1 atmosphere) and whose vapor pressure is not substantially greater than that of iron. Aluminum, silicon and zirconium are illustrative of useful oxidizable fuel materials. Aluminum is the preferred material for use in the present invention, and may be added as aluminum metal or as an aluminum alloy.

The preferred pneumatic process is the argon-oxygen decarburization process.

The present invention is applicable to prevent slopping in any steel melt which requires the addition of oxidizable fuel material beyond that contained in the charge for raising the temperature of the heat. Such steels include carbon steels, low alloy steels and tool steels.

DRAWING

FIG. 1 is a graph illustrating a typical time-temperature curve for two heats of steel made in accordance with the present invention and one by the prior art.

DETAILED DESCRIPTION OF THE INVENTION

At high carbon levels, in AOD refining of low alloy steels, the rate of carbon removal is dependent on the oxygen injection rate. As the oxygen injection rate is increased, decarburization and the tendency to slop are also increased. Heat loss consideratitons, however, require maintenance of a blow rate as high as possible without encountering slopping or refractory deterioration. It is consequently not feasible to combat slopping by severely limiting the oxygen injection rate.

Small freeboard volume results from improper vessel design and/or excessive heat size. Since slopping occurs after a slag emulsion is formed in the vessel, it is desirable to have a large freeboard volume available to accommodate the emulsion.

The process taught by Choulet and Mehlman referred to previously, while effective controlling temperature, results in slopping in some instances for reasons not fully understood. The present invention avoids slopping in all cases encountered.

The present invention is believed to prevent slopping by insuring that the combination of high carbon level and high temperature do not occur in conjunction with the presence of a slag-metal emulsion during decarburization. The driving force for carbon monoxide formation is lowered by lowering the decarburization temperature. A lower decaurburization temperature is obtained by not adding the aluminum or other heat generating oxidizable material until after decarburization has been substantially completed. Addititonally, maintenance of slag with relatively low tendency to form a foaming emulsion is ensured by not adding all the heat generating material, e.g. the aluminum, until after substantial decarburization has taken place. At a sufficiently low carbon level, i.e. about 0.50%, it has been found that the danger of slopping has passed.

The steps described above avoid slopping, while at the same time controlling the refining and tap temperatures. During decarburization, bath temperature is maintained or increased by the oxidation of silicon and metallics present in the melt before and during early decarburization. Following substantial decarburization, sufficient aluminum or other oxidizable material is added to maintain or increase the melt temperature as necessary prior to the reduction and finishing steps of the overall refining process.

The addition of aluminum or other oxidizable material to the melt should be in a controlled quantity such that the temperature of the melt is increased sufficiently to permit the subsequent endothermic refining steps to take place. In some instances, it is desirable to add a portion of the aluminum, as much as 35%, before decaurburization is completed or even commenced. This is desirable, for example, in order to deoxidize a highly oxidized melt prior to the addition of required carbon. Carbon may be added to insure adequate CO purge to assist in degassing the heat.

FIG. 1 illustrates typical temperature profiles of heats of carbon steel refined in accordance with the present invention (Curves A and B), and a heat refined by the prior art method of Choulet and Mehlman (Curve C). In Curve A, the oxidizable material (aluminum) is added after decarburization has been substantially completed. At that point, the aluminum is added to bring the temperature up to the desired level above tapping temperature in order to provide sufficient heat so that at the end of the finishing stage (shown in dotted lines) the melt is at least at the desired tapping temperature. In Curve B, about ⅓ of the total aluminum is added prior to decarburization. The aluminum causes the temperature of the melt to increase by about 100° F., (38° C.). Then, when decarburization is complete, the remainder of the aluminum is added to raise the temperature of the melt to the desired level which insures proper tapping temperature at the end of the finishing stage. Curve C represents the results obtained by Choulet and Mehlman in which all the aluminum, as well as the silicon or other slow oxidizing elements were added prior to decarburization.

The following examples will serve to illustrate the best mode of practicing the present invention.

EXAMPLE 1

A 44,000 lb (20,000 Kg) heat of HY-80 steel was made in a 25 short ton (23 metric ton) AOD refining vessel. The charge was melted under reducing conditions in an arc furnace. 1,360 lbs (620 Kg) of lime was charged to the AOD vessel before the melt was transferred from the arc furnace to the AOD vessel. Thereafter, 24,000 Ncfh (normal cubic feet per hour—measured at 70° F. and 1 atm. pressure) (10.5 $NM^3$/min) (normal cubic meters per minute—measured at 0° C. and 1 atm. pressure) of oxygen and 8,500 Ncfh (3.7 $NM^3$/min) of argon was injected into the melt according to conventional AOD refining methods to decarburize the melt and to remove silicon. The vessel was turned down after 27 minutes of the AOD blow. The temperature measured as 3,055° F. (1680° C.). 50 lbs (23 Kg) of nickel and 36 lbs (16 Kg) of molybdenum were added as alloy additions. 115 lbs (52 Kg) of aluminum was added for heat generation. The AOD blow was then resumed for 4 more minutes. The temperature at the end of this blow was 3,110° F. (1710° C.). 373 lbs (170 Kg) of 75% FeSi was then added as an alloy addition and the melt stirred with argon alone for 4 minutes. A melt chemistry sample was taken, and trim alloy additions were made and stirred with argon. The heat was tapped at 2,930° F. (1610° C.). No slopping was encountered. The carbon content at the time of aluminum addition was 0.17%, i.e. the specification carbon content.

EXAMPLE 2

A 74,000 lb (33,600 Kg) heat of AISI 1029 steel was made in a 40 short ton (36 metric ton) AOD vessel. The heat was decarburized to 0.06%C. in an arc furnace with mill scale and sufficient lime and limestone to form a basic dephosphorization slag. The furnace was slagged-off and tapped. 2,550 lbs (1160 Kg) of lime was precharged to the AOD vessel. The steel from the arc furnace and 100 lbs (45 Kg) of aluminum was then charged to the AOD vessel and stirred for 1 minute with argon. 550 lbs (250 Kg) of standard ferromanganese and 650 lbs (300 Kg) of graphite were added. The melt was then blown with 75,000 Ncfh (32.8 $NM^3$/min) of oxygen and 25,000 Ncfh (10.9 $NM^3$/min) of argon to decarburize the melt and remove silicon. After 8 minutes of argon-oxygen blowing, the vessel was turned down. The temperature was 2,850° F. (1565° C.). 700 lbs (140 Kg) of 75% FeSi was now added to the vessel and stirred with argon alone for 4 minutes. The heat wastapped at 2,980° F. (1640° C.). No slopping was encountered during the heat. The carbon content at aluminum addition was 0.28%C, i.e. the specification carbon content.

What is claimed is:

1. A method for preventing slopping during subsurface pneumatic refining of a steel melt which requires fuel additions, while simultaneously controlling the temperature of the melt, comprising:

adding an oxidizable fuel material to the melt in an amount sufficient to obtain the desired tap temperature at the end of the refining period, at a time after the melt has been decarburized to substantially the specification carbon content or after the carbon content has fallen below about 0.50%.

2. The method of claim 1, wherein the subsurface pneumatic refining process is the argon-oxygen decarburization process.

3. The method of claim 1, wherein the steel is selected from the group consisting of carbon steels, low alloy steels and tool steels.

4. The method of claim 1, wherein the oxidizable fuel material is aluminum.

5. The method of claim 1, wherein the subsurface pneumatic refining process is the argon oxygen decarburization process, wherein the steel is selected from the group consisting of carbon steels, low alloy steels and tool steels, wherein the oxidizable fuel material is aluminum and wherein up to 35% of the fuel material to be added is added before the melt has been substantially decarburized to the specification carbon content.

* * * * *

UNITED STATES PATENT AND TRADEMARK OFFICE

CERTIFICATE OF CORRECTION

PATENT NO. : 4,278,464

DATED : July 14, 1981

INVENTOR(S) : Roland P. Bury et al.

It is certified that error appears in the above-identified patent and that said Letters Patent are hereby corrected as shown below:

In col. 1, line 52, "slagmetal" should read -- slag-metal --.

In col. 2, line 13, "tyere(s)" should read -- tuyere(s)--.

In col. 2, line 30, "head" should read -- heat --.

In col. 4, line 8, "consideratitons" should read -- considerations --.

In col. 6, line 16, "wastapped" should read -- was tapped --.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*